US005950572A

United States Patent [19]

Heering et al.

[11] Patent Number: 5,950,572

[45] Date of Patent: Sep. 14, 1999

[54] OPENING THAT ALLOWS A SOOT BLOWER LANCE TO BE INTRODUCED THROUGH A TUBE CAGE

[75] Inventors: Jürgen Heering, Korschenbroich; Klaus Köhnen, Mülheim, both of Germany

[73] Assignee: Metallgesellschaft Aktiengesellschaft, Frankfurt am Main, Germany

[21] Appl. No.: 08/711,934

[22] Filed: Sep. 11, 1996

Related U.S. Application Data

[63] Continuation of application No. 08/711,934, Sep. 11, 1996, abandoned.

[30] Foreign Application Priority Data

Sep. 13, 1995 [DE] Germany ..... 195 33 908

[51] Int. Cl.[6] ..... F28G 15/00

[52] U.S. Cl. ..... 122/379; 122/392; 432/250

[58] Field of Search ..... 122/379, 380, 122/390, 391, 392, 405; 432/245, 246, 252, 247, 248, 249, 250, 251

[56] References Cited

U.S. PATENT DOCUMENTS

| | | | |
|---|---|---|---|
| 4,099,471 | 7/1978 | Sander et al. | 122/379 |
| 4,177,036 | 12/1979 | Sauder | 432/247 |
| 4,336,086 | 6/1982 | Rast | 432/248 |
| 4,411,621 | 10/1983 | Miller | 432/247 |
| 4,523,531 | 6/1985 | Bishara | 432/248 |
| 4,524,702 | 6/1985 | Miller et al. | 432/250 |
| 4,640,202 | 2/1987 | Schraff et al. | 432/250 |
| 5,088,262 | 2/1992 | Miller et al. | 432/248 |
| 5,238,055 | 8/1993 | Kelley | 122/379 |
| 5,320,073 | 6/1994 | Silcott et al. | 122/379 |
| 5,332,116 | 7/1994 | Nutter et al. | 432/248 |

*Primary Examiner*—Teresa Walberg
*Assistant Examiner*—Jiping Lu
*Attorney, Agent, or Firm*—Max Fogiel

[57] ABSTRACT

An opening arrangement in which a sliding plate accommodates a soot blower lance to be inserted into a medium-pressure gas-accommodating space through a tube cage in a boiler heated by waste heat. A soot blower box is provided with an elongated slotted hole. A frame is located between the sliding plate and the slotted opening, and a sheet of ceramic fiber is secured in the frame.

17 Claims, 3 Drawing Sheets

OPENING THAT ALLOWS A SOOT BLOWER LANCE TO BE INTRODUCED THROUGH A TUBE CAGE

This application is a continuation of application Ser. No. 08/711,934, filed Sep. 11, 1996, now abandoned.

BACKGROUND OF THE INVENTION

The present invention concerns a opening with a sheet-metal slide that allows a soot/blower lance to be introduced through a tube cage into a medium-pressure gas-accommodating space and high-pressure gas-accommodating space in a boiler heated by waste heat.

Medium-to-high pressure synthesis-gas coolers and waste-heat heated boilers are employed for example in pressurized coal-gasification plants. Their mutually perpendicular walls are constituted of tube-bar-design. Soot and other solid particles precipitate out of the synthesis gas and onto the inner surface of the walls. Lances are generally employed to blast the deposits away.

There is a separate opening through the tube cage for each lance. Each lance is accommodated in a box, and the gas-accommodating space between the box and the wall is welded gas-tight, sealing the hot-gas side off from the boiler's pressure shell.

The waste heat which is subjected to high pressure on the gas side comprise a boiler, gas-tight welded tube cage with additional tube panels, allowing any perceptible heat to be extracted from the synthesis gas and thereby cooling it. The tube cage and the tube panels are accommodated in a pressure shell. The shell is strong enough to accommodate the internal pressure. The shell and cooling system are mechanically connected.

When it is introduced into the waste heat boiler, the lance extends through the pressure shell and then through the tube cage. The reference points for the lances are the sockets on the shell.

The points where the lances are introduced through the walls of the inner structure are designed as sliding points, because of the prevailing temperature differences and due to the mechanical connection between the jacket and the structure, to allow back-and-forth motion.

Known lance boxes for use in conjunction with openings in the wall of a synthesis-gas cooler are currently being provided by the present applicant for the plant operated by the firm of Ruhrchemie in Oberhauses-Holten in the Ruhr.

These boxes comprise horizontal sheet-metal lance holders and vertical sheet-metal lance guides. The guides are slotted. Between them is a sliding plate with a round opening to accommodate the lance. Welded to the sliding plate is a sleeve that is wider inside than the opening through the slide.

The lance is surrounded inside the sleeve with a ring of packing material. A spacing sleeve is thrust over the packing and applies force to it by way of an annular spring, ensuring a tight seal between the inner and outer gas-accommodating spaces in the cooler.

The slide is unprotected and its inner surface exposed to high heat. The heat can lead to corrosion-derived wear and to temperature-dictated deformation. The slide can jam even though the pipes are kinked inside the opening and clad with a refractory ramming mass.

SUMMARY OF THE INVENTION

The object of the present invention is a soot blower lance opening that will be appropriate for the prevailing heat and pressure and for the requisite displacement while ensuring both gas-tightness and motion along with protection against high temperatures in the intermediate space and hence in the shell that accommodates the waste heat boiler.

There is a difference between the pressure in the gas-accommodating space inside the waste heat tube cage boiler's and the pressure in the gas-accommodating space between the tube cage and the shell. The hot gas in the interior cannot be allowed to escape into the space between the tube cage and the shell. The shell would get too hot.

The total area of penetration through the structure is accordingly encapsulated gas-tight with a lance box and a slide in accordance with the present invention. A slot through the box is closed with a sheet-metal slide mounted on the lance. There is a heat shield in the form of a sheet of ceramic-fiber felt heat insulation on the rectangular slide on the side of the box. The insulation is surrounded by a frame and secured with adhesive to the steel plate, which is lined with metal mesh.

Constant pressure of the slide against the lance box is conventionally ensured with a compression spring, which exerts the requisite sealing force by way of a spacing sleeve and O ring. There is a packing-material gasket in the sleeve to seal the slide off from the lance.

These measures ensure both vertical and horizontal freedom of motion along with a seal between the gas-accommodation space and the interior. Gas tightness is ensured by the pressure of the ceramic fiber against the housing. If the ceramic felt is adequately wear-resistant, the sheet can be accommodated in and extend beyond the frame, which is made of lengths of structural section. If the ceramic is less wear-resistant, it can extend only to the edge of the frame, and gas-tightness can be ensured with addition heat-resistant and resilient cords.

To allow the lance to enter the gas-accommodating space, two of the lengths of pipe tube cage are kinked out to create an opening. Since there is no defense against heat in the vicinity of the kinked-out lengths, the lance box and slide must be able to tolerate the total gas-accommodating space temperature of more than 1400° C. Since these components are not cooled, they must be protected from heat to eliminate the corrosion and deformation deriving from the high temperature.

The lance box is protected from heat by two different types of insulation, specifically by a blanket of ceramic fiber or glass wool resting against the box and by a refractory material facing the inside of the gas-accommodating space.

Since the ceramic fibers conduct significantly less heat than the refractory, the combination ensures ideal protection from heat. The refractory facing the gas-accommodating space must be cast or molded in order to resist fly ash and hot slag. The refractory is secured free-floating by the kinked-out lengths of pipe and by the anchors applied thereto.

The advantage of this design is that any differences in the heat expansion of the refractory, the lance box, and the pipes will not translate into increased stress or crumbling off of the refractory. Heat expansion will be unimpeded, the refractory will not crack, and parts of it will not crumble off.

The kinked-out lengths are also wrapped in foil for the same reason, to compensate for relative motion.

BRIEF DESCRIPTION OF THE DRAWINGS

The present invention will now be specified with reference to the accompanying drawing, wherein.

DESCRIPTION OF THE PREFERRED EMBODIMENTS

Figure 1:
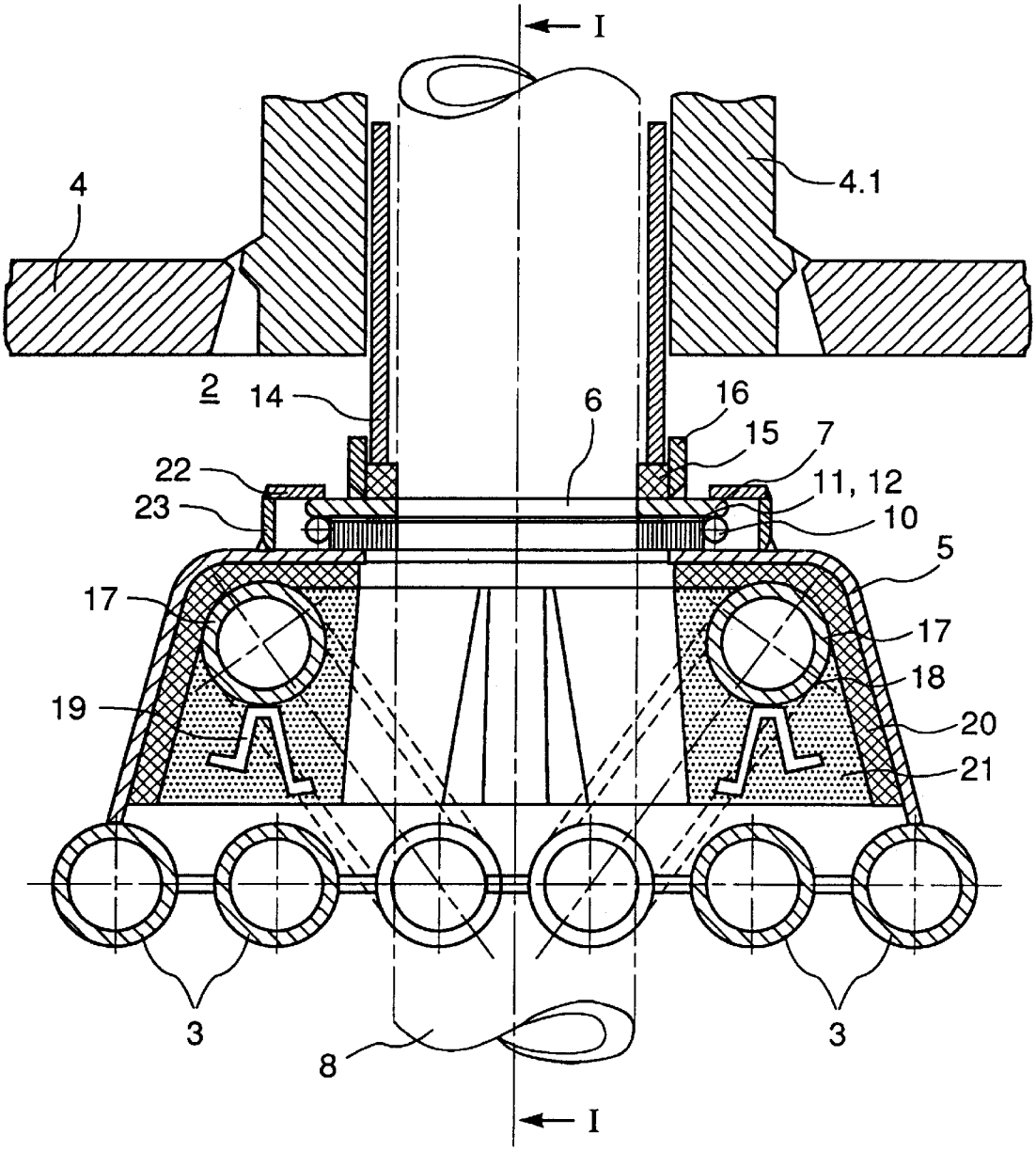
FIG. 1 is a cross-section through the lance box, FIG. 2 a longitudinal section along the line A-B in FIG. 1, FIG. 3 a detail of the box as illustrated in FIG. 1, and FIG. 4 a detail similar to FIG. 3 without a resilient cord.

The temperature prevailing in the gas-accommodating space 1 illustrated in FIG. 1 differs considerably and the pressure slightly from the temperature and pressure prevailing in the gas-accommodating space 2 between tube cage 3 and pressure shell 4.

To prevent the considerable heat prevailing in gas accommodating space 1 from entering gas-accommodating space 2, the whole passage through lance box 5 is insulated against heat and encapsulated gas-tight. The slotted opening 6 in lance box 5 is covered by a sliding plate 7 mounted over lance 8. Slide 7 is lined with metal mesh 12.

The surface of slide 7 facing lance box 5 is covered by a sheet 9 of ceramic-fiber felt insulation. Insulation sheet 9 is surrounded by a frame 10 of steel structural section and secured to slide 7 with heat-resistant glue material 11.

Slide 7 is pressed against lance box 5 by a compression spring which applies the necessary sealing force by way of a space sleeve 14 and O ring 15.

Sleeve 16 is packed with a gasket that seals slide 7 off from lance 8. Anchors 19 are mounted against two kinked-out lengths 17 of pipe, which are also wrapped in foil 18 and then embedded in a blanket 20 of ceramic fiber and cast or rammed refractory material 21.

Figure 2:
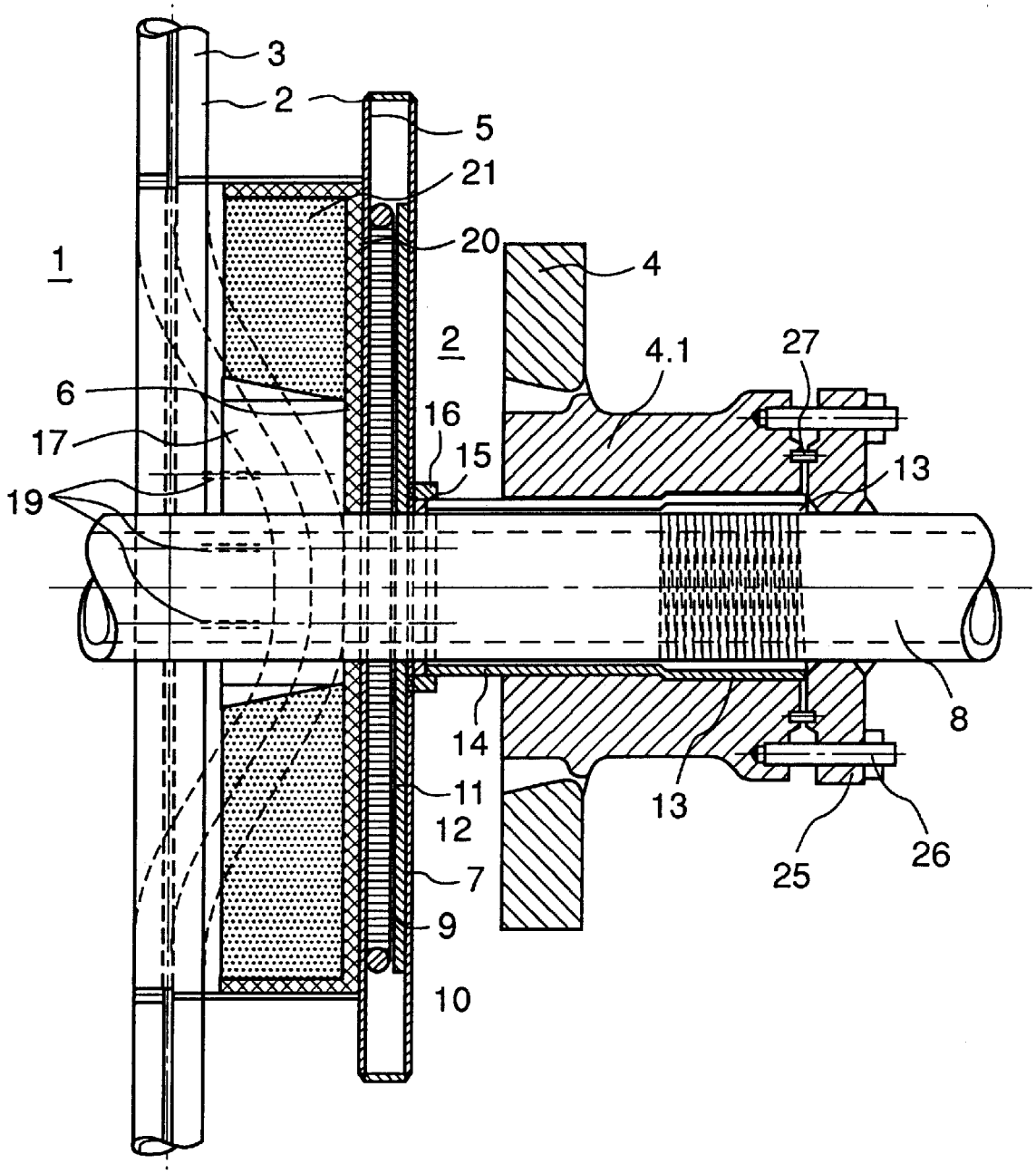

As will be evident from FIG. 2, two lengths 17 of the pipe that comprises structure 3 are bent out in the vicinity of the penetration of lance 8, and lance box 5 and slide 7 are accordingly exposed to heat to the full extent. Since components 5 and 7 are not cooled, they must be insulated against heat.

The interior of lance box 5 is accordingly protected by two types of insulation—a ceramic-fiber or glass-wool blanket 20 resting against lance box 5 and cast or stamped refractory material 21 facing the gas-accommodating space. The refractory is secured free-floating by the kinked-out lengths 17 of pipe and by the anchors 19 applied thereto.

Kinked-out lengths 17 of pipe are also wrapped in foil 18 to compensate for relative motion. Lance 8 is conventionally secured to a flange 25 by fasteners 26 and seals 27 positioned on connections 4.1 positioned on pressure vessel 4. A compression spring 13 rests against a spacing sleeve 14 with a packing-material gasket 15 inside sleeve 16, ensuring gas-tightness by way of the slide 7 between gas accommodating space 1 and the gas-accommodating space 2 between the synthesis-gas cooler's pipe structure 3 and pressure vessel 4.

Figure 3:
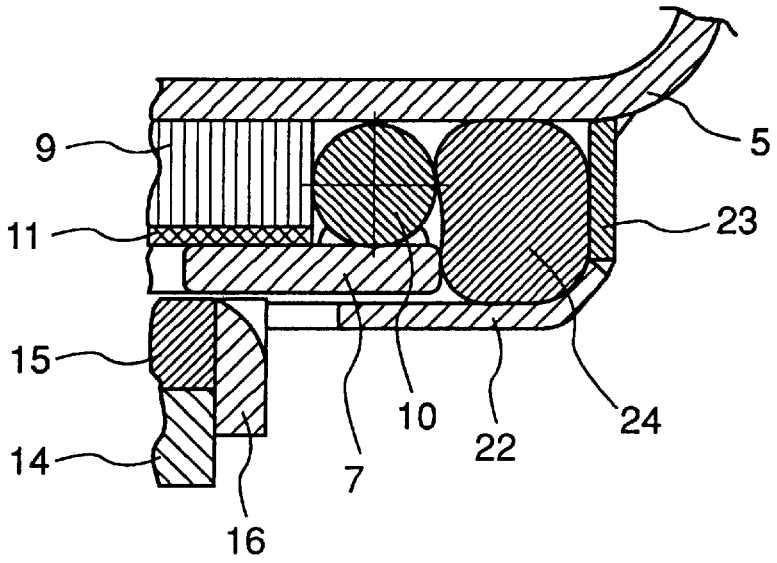

As will be evident from FIG. 3, when the fiber-blanket material is adequately resistant to wear, insulation sheet 9 can be allowed to extent beyond the edge of frame 10. If the material is less resistant to wear, it can be coterminous with the thickness of the frame, and gas-tightness can be further ensured with a heat-resistant and resilient cord 24. Cord 24 is accommodated between a sheet-metal guide 22 and a sheet-metal holder 23 in lance box 5 and metal structural-section frame 10.

Figure 4:
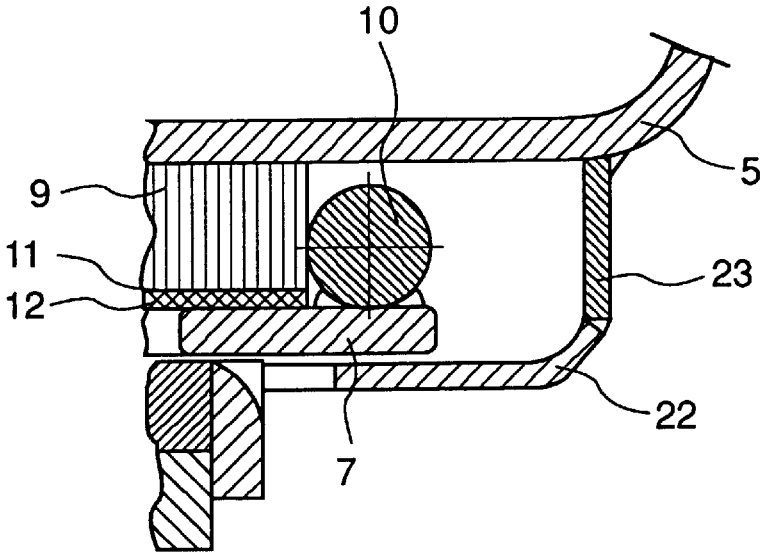

As illustrated in FIG. 4, the gas-accommodating space can be sealed exclusively by a sheet 9 of ceramic-fiber insulation secured to sheet-metal slide 7 by glue material 11 and metal mesh 12 and applying force to the sheet metal in lance box 5. Sheet 9 of ceramic-fiber insulation is thicker than metal structural-section frame 10.

Sheet 9 of ceramic-fiber insulation slides along the inner surface of sheet-metal guide 22, which is attached to lance box 5 by a lateral metal sheet 23.

We claim:

1. A lance soot blower arrangement comprising: a tube slab structure in a waste heat boiler with an outer shell; a soot medium-pressure gas-accommodating space adjacent said structure for cleaning walls of said boiler; a soot blower box mounted on said tube slab structure and having a slotted opening; a sliding plate covering said slotted opening and accommodating said soot blower lance; a frame between said sliding plate and said slotted opening; a sheet of ceramic fiber secured in said frame and being a heat shield; said opening being a soot blower lance gas-tight opening and accommodating motion, said opening protecting against high temperatures in said medium-pressure gas-accommodating space and thereby protecting against high temperatures in said shell of said boiler, hot gas being prevented from escaping into a space between said tube slab structure and said shell; a housing surrounding said ceramic fiber, gas tightness being secured by pressure of said ceramic fiber against said housing; tube bends formed from tubes in said tube slab structure and bent out adjacent said lance for admitting said lance into said gas-accommodating space; said soot blower box being protected from heat by a blanket of ceramic fiber resting against said box and by a refractory material facing inside said gas accommodating space; anchors on said tube bends for securing said refractory material; heat expansion of said refractory material, soot blower box, and tubes being inhibited from increasing stress and thereby crumbling off of said refractory material.

2. A lance soot blower arrangement comprising: a tube slab structure in a waste heat boiler with an outer shell and having an opening; a soot blower lance inserted through said opening and into a medium-pressure gas-accommodating space adjacent said structure for cleaning walls of said boiler; a soot blower box mounted on said tube slab structure and having a slotted opening; a sliding plate covering said slotted opening and accommodating said soot blower lance; a frame between said sliding plate and said slotted opening; a sheet of ceramic fiber secured in said frame and being a heat shield; a metal mesh lining said sliding plate; said sheet of ceramic fiber being insulation secured to said sliding plate by glue material; said sheet of ceramic fiber extending beyond said frame; heat-resistant cord for sealing said soot blower box, said sheet of ceramic fiber being as thick as said frame; tube bends formed from tubes in said tube slab structure and bent out adjacent said lance and anchors on said tube bends; said tube bends being wrapped in foil and partially with a ceramic-fiber blanket and refractory material; said ceramic-fiber blanket resting against an inner surface of said soot blower box; said refractory material floating freely in said soot blower box; said refractory material resting against an inner surface of said soot blower box and sloping out below said slotted opening; said sheet of ceramic fiber secured in said frame being a heat shield, said slotted opening being a soot blower lance gas-tight opening and accommodating motion, said slotted opening protecting against high temperatures in said medium-pressure gas-accommodating space and thereby protecting against high temperatures in said shell of said boiler, hot gas being prevented from escaping into a space between said tube slab structure and said shell; a housing surrounding said ceramic fiber, gas tightness being secured by pressure of said ceramic fiber against said housing; said tube bends in said tube slab structure admitting said lance into said gas-accommodating space; said soot blower box being protected from heat by a blanket of ceramic fiber resting against said box and by a refractory material facing inside said gas accommodating space; said anchors securing said refractory material; heat expansion of said refractory material, soot blower box, and tubes being inhibited from increasing stress and thereby crumbling off of said refractory material.

3. In a waste-heat boiler comprising: an outer pressurization jacket (4); a tube slab structure with tubes (3) within said jacket; a cooling fluid being fed through said tubes of said structure, said structure surrounding a hot gas space (1) flown through by hot gas under superatmospheric pressure, a hot gas-accommodating space (2) being located between said jacket and said structure; a soot blower lance (8) removably fastened and gas-tightly sealed in a first opening in said jacket (4) and in a second opening in said tube slab structure; a soot blower box (5) mounted on said tube slab structure and positioned in said hot gas-accommodating space; said box (5) having a slotted opening (6) through which said lance penetrates into said hot gas space (1), said lance feeding a cleaning fluid towards said tube slab structure; thermally insulating material within said blower box (5) and surrounding said lance and at least one tube (17) for cooling fluid; a sheet of ceramic fibers (9) surrounding said lance (8) in said blower box; a metal frame also surrounding said sheet; a sliding plate (7) with a first sleeve (16) mounted over said lance and facing said box; a sealing ring (15) held against said slide within said first sleeve; a second sleeve (14) on said lance for forcing said slide against said box; and a compression spring on said lance and abutting said second sleeve for forcing said second sleeve against said ring and pressing said ring onto said sliding plate and against said lance for keeping said sheet close to said blower box.

4. An arrangement as defined in claim 3, including metal mesh lining said sliding plate; said sheet of ceramic fiber being insulation secured to said sliding plate by glue material.

5. An arrangement as defined in claim 3, wherein said sheet of ceramic fiber extends beyond said frame.

6. An arrangement as defined in claim 5, including heat-resistant cord for sealing said soot blower box, said sheet of ceramic fiber being as thick as said frame.

7. An arrangement as defined in claim 3, including tube bends in said tube slap and structure on said tube bends.

8. An arrangement as defined in claim 7, wherein said tube bends are wrapped in foil and partially with a ceramic-fiber blanket and refractory material.

9. An arrangement as defined in claim 8, wherein said ceramic-fiber blanket rests against an inner surface of said soot blower box.

10. An arrangement as defined in claim 8, wherein said refractory material floats freely in said soot blower box.

11. An arrangement means as defined in claim 8, wherein said refractory material rests against an inner surface of said soot blower box and slopes out below said elongated hole.

12. An arrangement as defined in claim 7, wherein said tube bends are wrapped in foil and partially with glass wool and refractory material.

13. An arrangement as defined in claim 12, wherein said glass wool rests against an inner surface of said soot blower box.

14. An arrangement as defined in claim 12, wherein said refractory material floats freely in said soot blower box.

15. An arrangement means as defined in claim 12, wherein said refractory material rests against an inner surface of said soot blower box and slopes out below said elongated hole.

16. A waste-heat boiler of claim 3, wherein said thermally insulating material comprises a blanket (20) of ceramic fibers and refractory material (21), said refractory material facing said hot gas space (2).

17. A waste-heat boiler as defined in claim 3, including a heat-resistant and resilient cord (24) surrounding said metal frame and in contact therewith and being pressed against said box (5), and against said plate (7); a metal guide (22) connected to a metal holder (23) attached to said box; said guide and said holder being fastened to said box (5).

* * * * *